US009772074B1

(12) United States Patent
Bronstein

(10) Patent No.: US 9,772,074 B1
(45) Date of Patent: Sep. 26, 2017

(54) LASER DIODES BASED ILLUMINATION DEVICE

(71) Applicant: Rafail Bronstein, Kfar Saba (IL)

(72) Inventor: Rafail Bronstein, Kfar Saba (IL)

( * ) Notice: Subject to any disclaimer, the term of this patent is extended or adjusted under 35 U.S.C. 154(b) by 38 days.

(21) Appl. No.: 15/339,959

(22) Filed: Nov. 1, 2016

Related U.S. Application Data

(60) Provisional application No. 62/405,278, filed on Oct. 7, 2016.

(51) Int. Cl.

| | |
|---|---|
| ***F21V 9/16*** | (2006.01) |
| ***F21K 9/62*** | (2016.01) |
| ***F21K 9/232*** | (2016.01) |
| ***F21K 9/64*** | (2016.01) |

(52) U.S. Cl.
CPC ..... *F21K 9/62* (2016.08); *F21K 9/232* (2016.08); *F21K 9/64* (2016.08)

(58) Field of Classification Search
CPC ..... F21K 9/62; F21K 9/64; F21K 9/232
See application file for complete search history.

(56) References Cited

U.S. PATENT DOCUMENTS

| | | | | |
|---|---|---|---|---|
| 5,535,238 | A | 7/1996 | Schilling | |
| 6,791,259 | B1 | 9/2004 | Stokes et al. | |
| 7,086,765 | B2 | 8/2006 | Wehner | |
| 7,281,823 | B2 | 10/2007 | Moisel | |
| 8,593,956 | B2 | 11/2013 | Tiwari | |
| 8,625,097 | B2 | 1/2014 | Brukilacchio et al. | |
| 8,742,654 | B2 | 6/2014 | Cabalu et al. | |
| 8,750,671 | B1 * | 6/2014 | Kelly | F21V 3/049 362/335 |
| 8,948,564 | B1 | 2/2015 | Sherman et al. | |
| 2012/0169235 | A1 * | 7/2012 | Dassanayake | F21V 3/049 315/113 |
| 2012/0287633 | A1 * | 11/2012 | Kelly | F21V 3/0463 362/235 |
| 2013/0077285 | A1 * | 3/2013 | Isogai | F21V 23/006 362/84 |
| 2014/0334126 | A1 | 11/2014 | Speier et al. | |
| 2015/0219315 | A1 | 8/2015 | Park et al. | |
| 2016/0061392 | A1 | 3/2016 | Harbers et al. | |

FOREIGN PATENT DOCUMENTS

| | | |
|---|---|---|
| WO | 2007073496 | 6/2007 |

* cited by examiner

*Primary Examiner* — Alexander Garlen
(74) *Attorney, Agent, or Firm* — Manelli Selter PLLC; Edward J. Stemberger

(57) ABSTRACT

An illumination device includes a bulb including a segment of at least second order curvature and a cylindrical segment. A least two laser diodes are coupled with the bulb such that laser beams emitted by the at least two laser-diodes propagate inside the bulb through total internal reflection. The laser beams propagating in the bulb expand in the bulb, are evenly mixed and exceed outward from the bulb as a volumetric light flux.

19 Claims, 12 Drawing Sheets

LASER DIODES BASED ILLUMINATION DEVICE

The present application claims priority to U.S. provisional application No. 62/405,278 filed Oct. 7, 2016, the contents of which are hereby incorporated by reference into this specification.

TECHNOLOGY FIELD

This current disclosure is related to illumination devices and in particular to illumination devices using laser diodes as an excitation source.

BACKGROUND

There is a number of known illumination devices. Some of the devices are simple incandescent lamps, fluorescent lamps, LED (Light Emitting Diode) based lamps and others. In light emitting diodes (LEDs) based devices, light is produced by one or more LEDs organized to deliver a desired level of illumination on a defined surface area. LEDs are more efficient than incandescent or fluorescent lamps, e.g., LEDs produce up to 100 lumens per watt of consumed electrical energy vs 10-50 lumens per watt produced by incandescent or fluorescent lamps.

One of the problems related to LEDs based is reduction in efficiency as operating currents rise, making the devices too hot to power in large-scale applications.

U.S. Pat. Nos. 5,535,238, 6,791,259, 7,086,765, 7,281,823, 8,742,654, 8,625,097, 8,593,956, 8,948,564 and US Patent Application Publications 2015/0219315, 2016/0061392, disclose different configurations of LEDs based illumination devices.

However, the life constantly requires brighter and more efficient light sources or devices using less energy than the existing light devices. Use of laser diodes as excitation source to excite different inorganic phosphors in illumination devices is believed to be alternative means for high-power white light instead of the traditional LEDs. The more directional nature of the laser diode beams, as compared to LEDs, may be utilized to avoid some optical inefficiencies. The laser diode based lighting devices are higher in efficiency, although in some cases they require excitation by blue laser diodes and a combination of different phosphors.

Patent Cooperation Treaty WO2005/107240, WO2007/073496 and WO 2007/107420 and U.S. Pat. Nos. 8,625,097, 8,948,564 and US Patent Application Publication No. 20140334126, disclose different configurations of laser diodes based illumination devices.

DEFINITIONS

Bulb—as used in the current disclosure the term bulb means an illumination device that produces visible light. Bulb, as it will be explained below could be an assembly of different details or parts of the bulb.

Globe—as used in the current disclosure the term globe means a radiating surface of the bulb used to more evenly disperse the light produced. The globe may have a traditional frosted white incandescent bulbs appearance. The globe could also include phosphorous and other coatings.

Base—as used in the current disclosure the term base means a portion of the bulb that screws into existing standard electric bulb/lamp sockets. Heatsink—as used in the current disclosure the term heatsink means a portion of the bulb that is used to disperse heat generated by operation of electrical components. In some examples heatsink could include a number of fins that enhance heat dispersion.

SUMMARY

Efficiency is a key factor for selecting proper light source. LED base illumination sources LEDs produce 50-80 lumens per watt of consumed electrical energy vs 170-250 lumens per watt produced by laser lighting. The current bulb construction supports placement of a desired number of laser diodes in a limited space of the bulb (lamp) and convert their narrowly focused beams so that they become uniformly illuminating the inner space of the bulb and the globe, which is the radiating surface of the bulb.

The radiating surface could be coated by a phosphorous coating or made frosted and light diffusing to uniformly emit in the ambient volume the light generated by excited phosphor coating or by a mixture of a number of wavelength emitted by laser diodes.

DESCRIPTION OF DRAWINGS

The present illumination device will be understood and appreciated from the following detailed description, taken in conjunction with the drawings in which.

DETAILED DESCRIPTION OF EXAMPLE EMBODIMENTS

Figure 1:
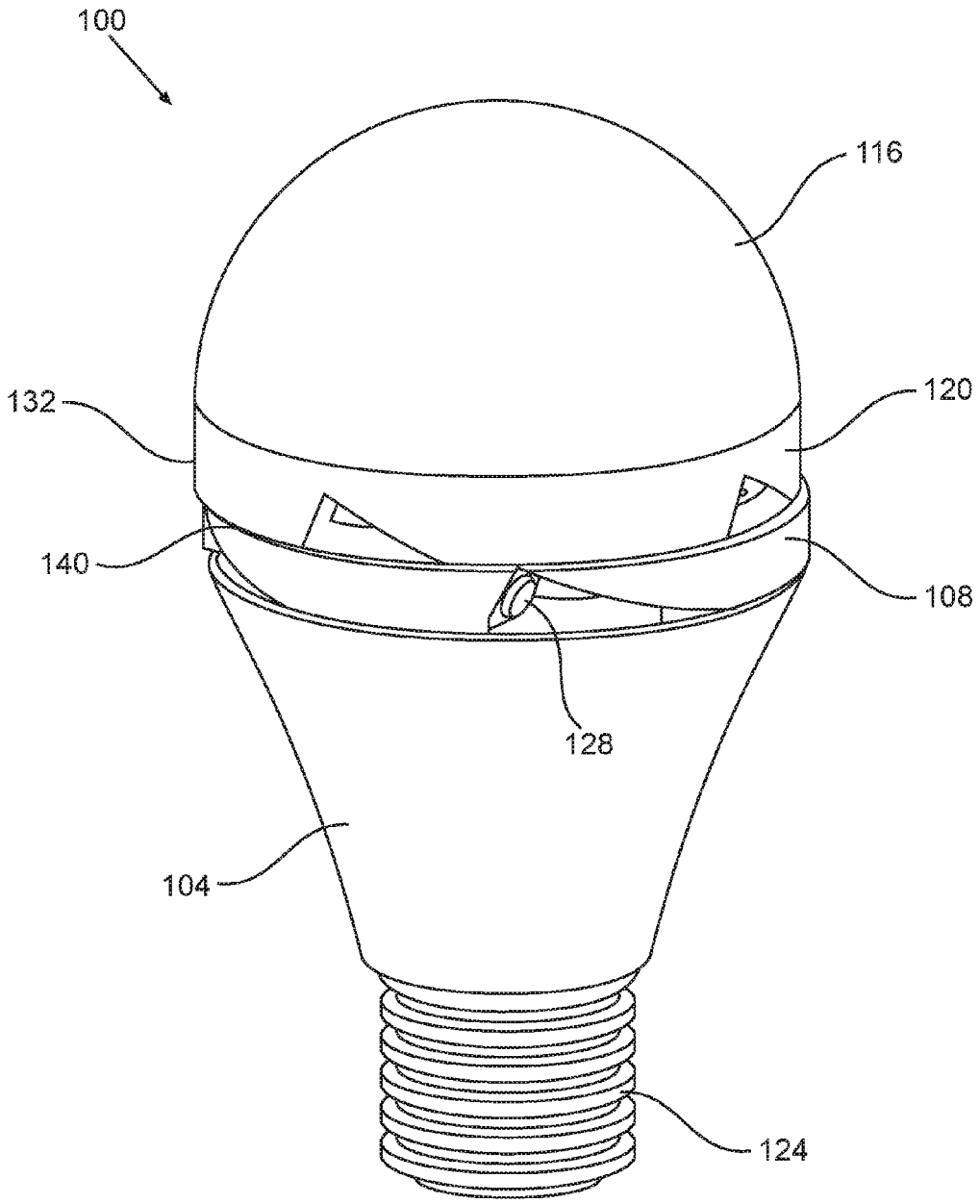
FIG. 1 is an example of a current illumination device using laser diode as an excitation source.

FIG. 1 is an example of the current illumination device using laser diode as an excitation source. Illumination device or bulb 100 includes a housing 104, a ring 108 and a globe 116. The globe could be a body with second order (spherical) or a higher order curvature and include a cylindrical segment 120. Globe 116 serves to guide laser diodes emitted light or beam that excites different phosphors deposited on inner or outer surface of the globe and volumetrically disperse the emitted by one or more phosphors light flux. A standard base 124 (screw-in) supports illumination device or bulb 100 connection to mains. Ring 108 is configured to receive a number of laser diodes 128. The number of laser diodes could be one, two, ten or more.

Housing 104 could be made of metal, composite material or another material with good thermal conductivity. Housing 104 could dissipate heat generated by operation of laser diodes 128. Ring 108 would typically be made of a good heat conducting material, such as for example aluminum or copper. Globe 116 including cylindrical segment 120 would typically be made of a transparent material such as glass, plastic or similar and as it will be explained below coated by appropriate coating.

Cylindrical segment 120 facilitates coupling of laser light emitted by laser diodes 128 to globe 116. Laser diodes 128 could be oriented in their mounts or nests such that the light or laser beam/s emitted by laser diodes 128 is directed in a direction tangential to the surface 132 of cylindrical segment 120 and as it will be explained below at an angle to mating with ring 108 butt-end surface 140 of cylindrical segment 120. Laser light or beam/s emitted by laser diodes at an angle to mating with ring 108 butt-end surface 140 are reflected from surface 132 of cylindrical segment 120 to propagate inside cylindrical segment 120 that serves as a light guide and further coupled to the globe 116 such that the laser beams propagate inside the globe through total internal reflection.

The laser beams propagating in globe 116 expand in the globe, are evenly mixed and excite the phosphorous coating selected to emit a desired mix of wavelengths. In some examples the laser beams propagating in the globe 116 could exceed outward from the globe as a volumetric light flux.

In some examples both external surface 132 and internal surface 212 (FIG. 2) of cylindrical segment 120 could be coated by a light reflecting coating to enhance the internal reflection of the laser beam emitted by different laser diodes. In some examples both external surface 132 and internal surface 212 of cylindrical segment 120 could be curved surfaces.

Figure 2:
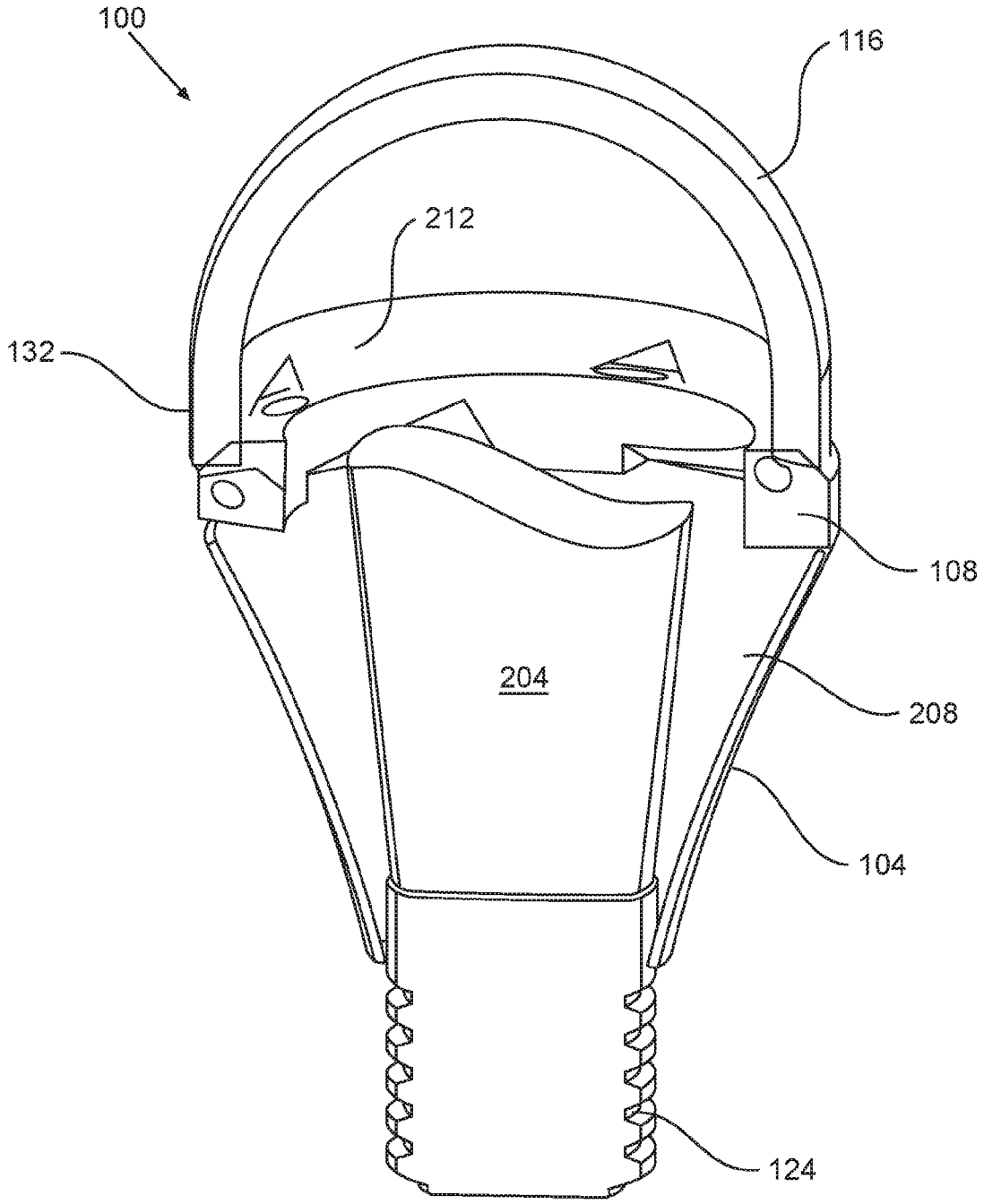
FIG. 2 is a cross section of illumination device of FIG. 1.

FIG. 2 is a cross section of illumination device of FIG. 1. Laser diodes driver 204 that provides electric power to laser diodes 128, could be placed inside the illumination device or bulb 100. Laser diodes driver 204 could occupy the space inside base 124 and even inside the whole inner space 208 of illumination device or bulb 100. Laser beams emitted by laser diodes 128 propagate inside globe 116 and do not enter inner space 208 of illumination device or lamp (bulb) 100.

Figure 3:
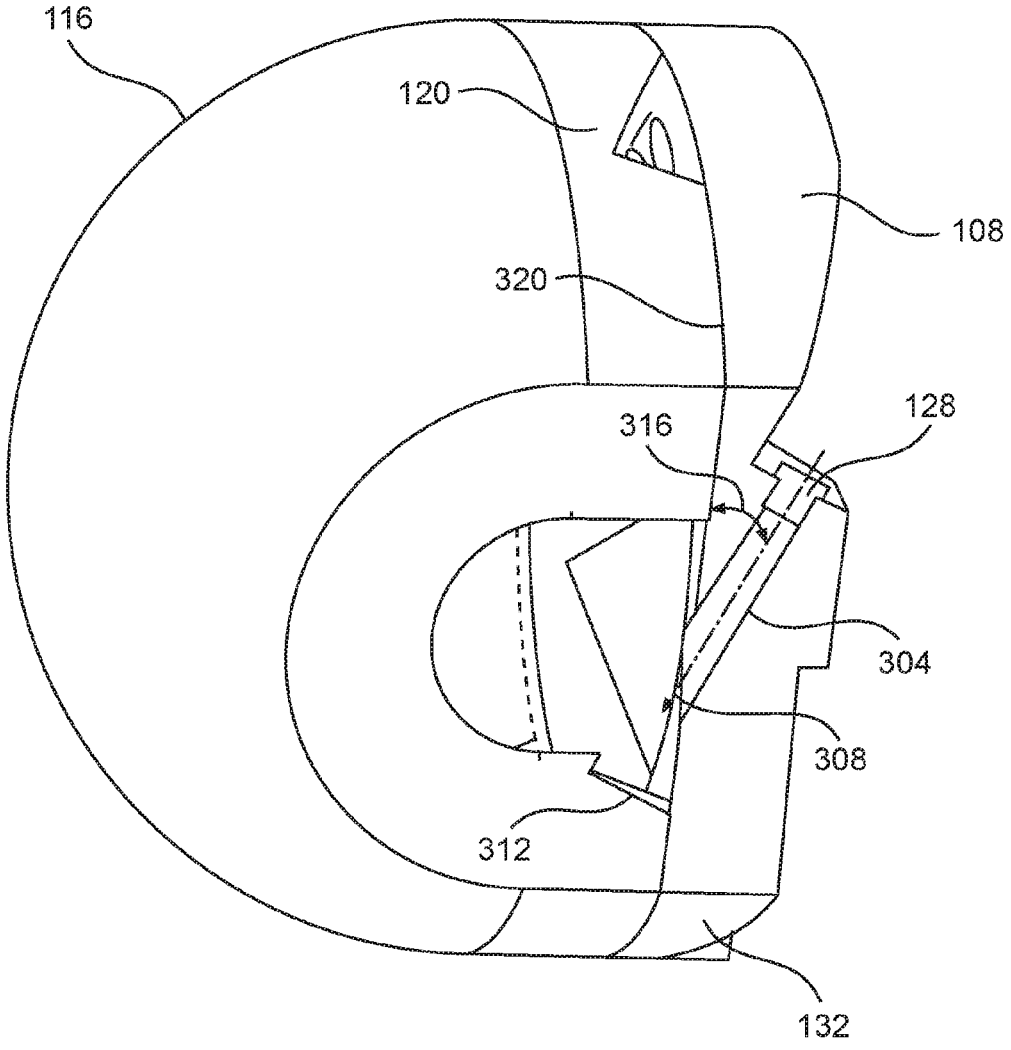
FIG. 3 is an example of a current illumination device illustrating a globe and globe mating surface coupling.

As shown in FIG. 3, ring 108 houses a number of laser diodes 128 mounted in nests 304. Nests 304 are implemented as a through hole or opening in ring 108. Nests 304 supports propagation of laser light or beam 308 emitted by laser diode 128 to a located opposite nest 304 beam receiving surface 312 made in butt-end of cylindrical segment 128 or directly in globe 116.

There could be a large number (plurality) of nests 304 in ring 108. Nests 304 (also in FIG. 4) are inclined at an angle 316 to mating surfaces 320 of ring 108 and cylindrical segment 120 of globe 116. Rays 308 emitted by laser diodes 120 are directed tangentially to surface 132 of cylindrical segment 120 of globe 116 and are reflected and dispersed in globe 116.

Figure 4:
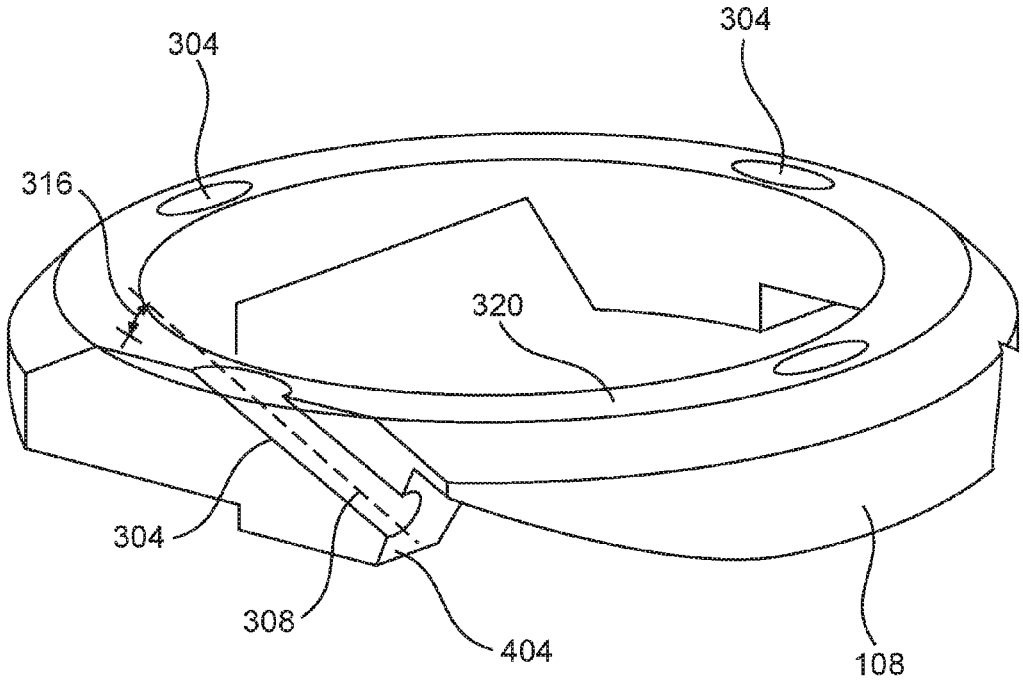
FIG. 4 is a three dimensional illustration of ring according to an example.

In FIGS. 3 and 4, nests 304 are oriented in the same direction. In some examples nests 304 could be oriented towards each other or in opposite directions. Accordingly, some laser diodes located in receptacles or nests 304 would be oriented in the same direction at angles equal to the angles of receptacles and/or in opposite directions.

In some examples ring 108 could be implemented as a cylindrical segment of housing 104, which is also made from heat conducting material and serves as laser diodes driver heatsink.

FIG. 4 is three dimensional illustration of ring according to an example. Nests 304 are configured to receive laser diodes 128 (not shown). Nests 304 begin from a flat surface 404 that is configured to set the laser diode into nest 304 insertion depth and support the laser diode.

Figure 5:
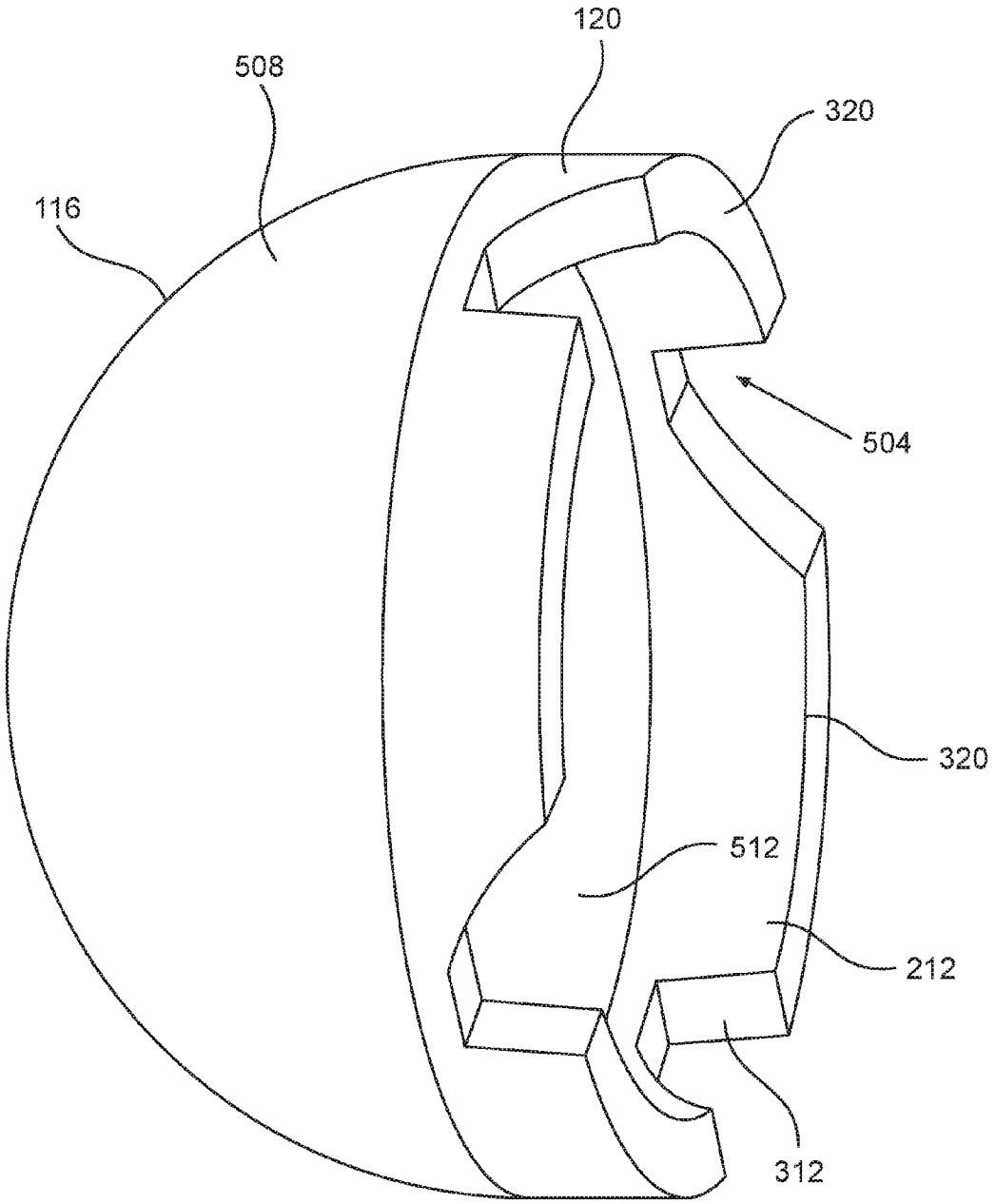
FIG. 5 is an illustration of a globe including a cylindrical segment according to an example.

FIG. 5 is an illustration of a globe including a cylindrical segment according to an example. Globe 116 wall thickness is defined by the distance between external or outer 508 and internal or inner 512 surfaces of globe 116. Globe 116 wall thickness would typically be between 2 to 5 mm and usually 3 mm. Such globe 116 wall thickness is sufficient to support even non-collimated laser beams 308 (FIG. 3) emitted by laser diode 128 (FIGS. 1 and 3) and propagating inside globe 116. Such thickness also supports laser beams inside globe 116 expansion and mixing. The laser beams (emitted by the laser diodes) propagate inside the globe 116 and are evenly mixed along a helical trajectory. (An average laser diode beam has a beam divergence (FWHM) of 5-9 degrees in one plane and 21-28 degrees in another plane.).

Globe 116 includes a cylindrical segment 120, where expansion and mixing of emitted by the laser diodes beams also takes place. In one example, cylindrical segment 120 is integral or unitary with globe 116. In another example, cylindrical segment 120 is a separate from globe 116 part and they are joined in course of illumination device or bulb 100 assembly. Globe 116 is the radiating section of illumination device or lamp 100.

Although described as a cylindrical segment 120, in some examples both external surface 132 and internal surface 212 of cylindrical segment 120 could be curved surfaces.

Phosphorous coating could be deposited on outer or external surface 508, on inner or internal 512 surface or on both outer 508 and inner 512 surfaces of globe 116. Phosphorous coating on inner 512 surface of globe 116 could be over coated by a reflection coating to enhance the amount of light emitted by the globe 116. Phosphorous coating deposited on outer surface 508 of bulb 108 could be coated by a scratch preventive or other protective coating. In some examples the protective coating could be a polymeric shell.

The number of cut-outs 504 in globe 116 corresponds to number of laser diodes inserted into ring 108 or cylindrical segment 120, if the laser diodes are inserted in the cylindrical segment. Cut-outs 504 are also configured to reduce to minimum the return loss of laser diode 128 (FIGS. 1 and 3) emitted light beams 308 (FIG. 3). The introduction of laser light beams 308 is arranged perpendicular to surface 316. The second surface of cut-out 504 can be curvilinear surface for the best reflection and scattering of laser beams.

Figure 6:
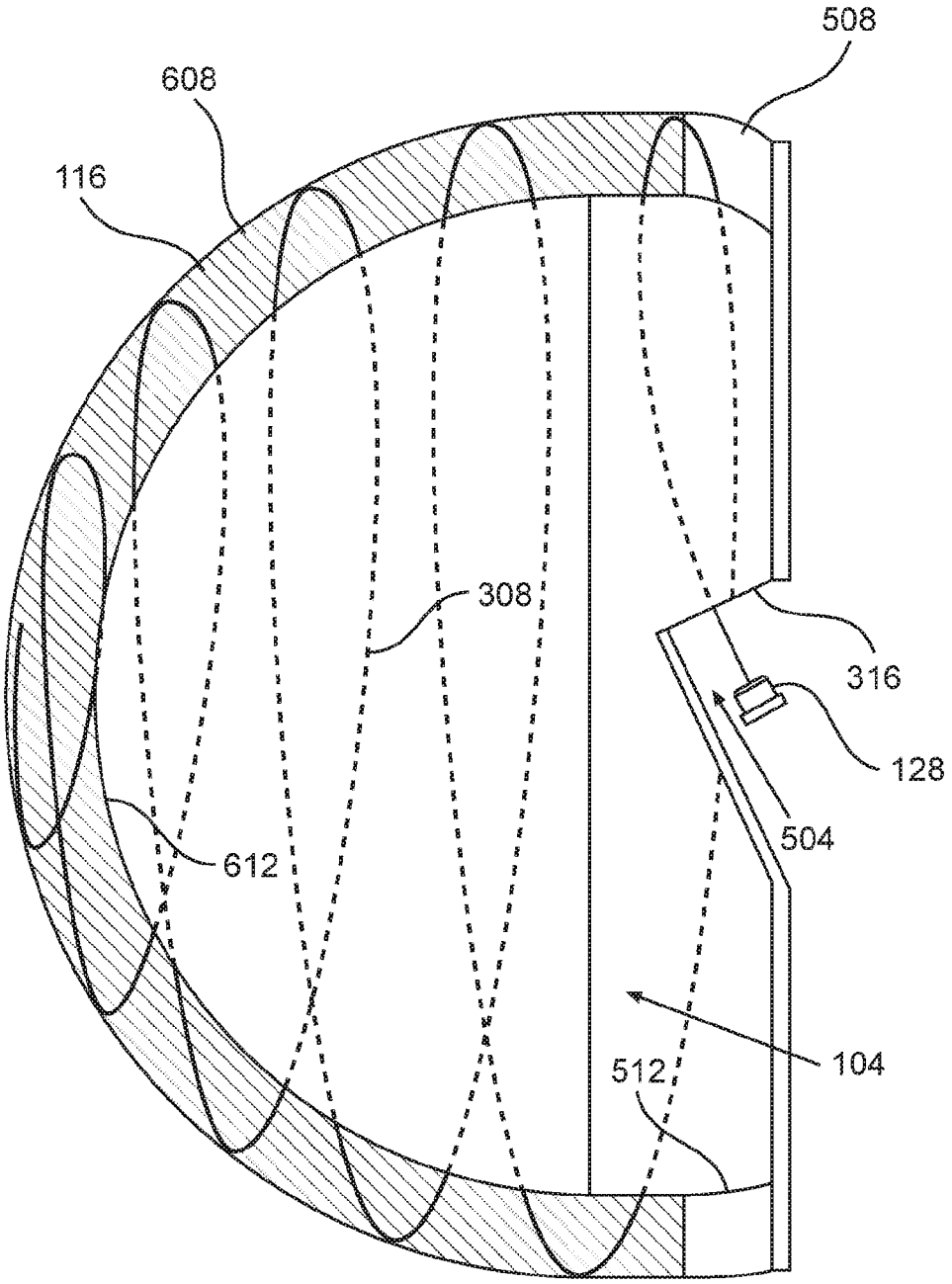
FIG. 6 is an illustration of propagation of laser diode beams in the globe according to an example.

FIG. 6 is an illustration of propagation of laser diode light beams in globe 116. Laser diode emitted light beams 308 (FIG. 3) enter cylindrical segment 108 through flat surfaces 312 of cut-outs 504 made in cylindrical segment 108. Flat surfaces 312 facilitate laser diode emitted light beams 308 into cylindrical segment 108 coupling. Although, laser diode emitted light beams 308 propagate in cylindrical segment 108 through total internal reflection both outer 312 and inner 212 surfaces of cylindrical segment 108 could be covered by a reflective coating. In some examples, flat surfaces 312 could be coated by an anti-reflection coating optimized for the particular laser diode wavelength.

In some examples flat surface 312, through which laser beams enter into cylindrical segment 108 can have a certain roughness or a relief for the better propagation and scattering laser diode emitted beams.

In some examples both outer 508 and inner 512 surfaces of cylindrical segment 108 could have a certain roughness or a relief to improve propagation and scattering of laser diode emitted beams 308. Additional light diffusing elements could also be included in cylindrical segment 120.

Globe 116 serves as light guide and laser diode emitted beams 308 are repeatedly reflected from the outer 608 and inner 612 surfaces of globe 116. Beams 308 extend along a helix curve, mixed up and are expanded. Beams 308 are mixed into a homogenous flux propagating between outer 608 and inner 612 surfaces of bulb 108 to completely and evenly illuminate the entire radiating surface of globe 116.

In some examples inner surface 612 of globe 116 could be coated by a light reflecting coating. The coating could be a regular reflective coating or a reflecting foil and/or a polymer shell with index of refraction lower than the index of refraction of the globe.

In some examples outer surface 608 of globe 116 could have certain roughness or a traditional frosted white appearance to evenly disperse the light emitted by the phosphorous coating.

Figure 7:
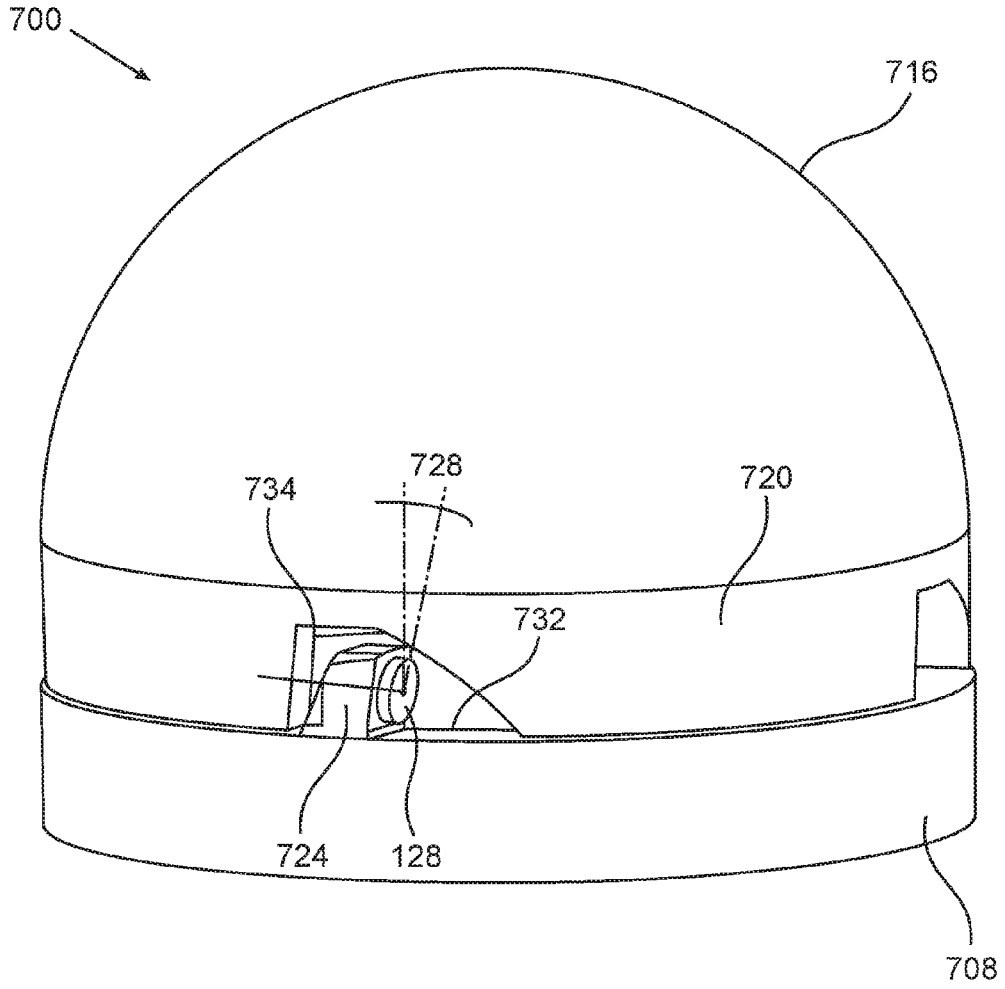
FIG. 7 is another example of an illumination device using laser diode as an excitation source.

FIG. 7 is another example of an illumination device using laser diode as an excitation source. Generally only globe 716 and ring 708 are shown. Globe 716 could have a spherical or a higher order curvature. Globe 716 serves to guide laser diodes emitted light or beam that excites different phosphors deposited on inner surface of globe 716 and disperse the emitted by phosphors light that exceeds outward from the globe as a volumetric light flux. Globe 716 could include a cylindrical segment 720. Ring 708 includes a number of protrusions 724 with nests (not shown) implemented in each protrusion 724. The nests are configured to receive laser diodes 128. The nests could be oriented at an angle 728 to surface 732 of ring 708. Angle 728 is selected such that emitted by laser diode beams 740 would undergo in cylindrical segment 720 a total internal reflection. Depending on the refractive index of globe 716 material, angle 728 could be 10 to 15 degrees.

Figure 8:
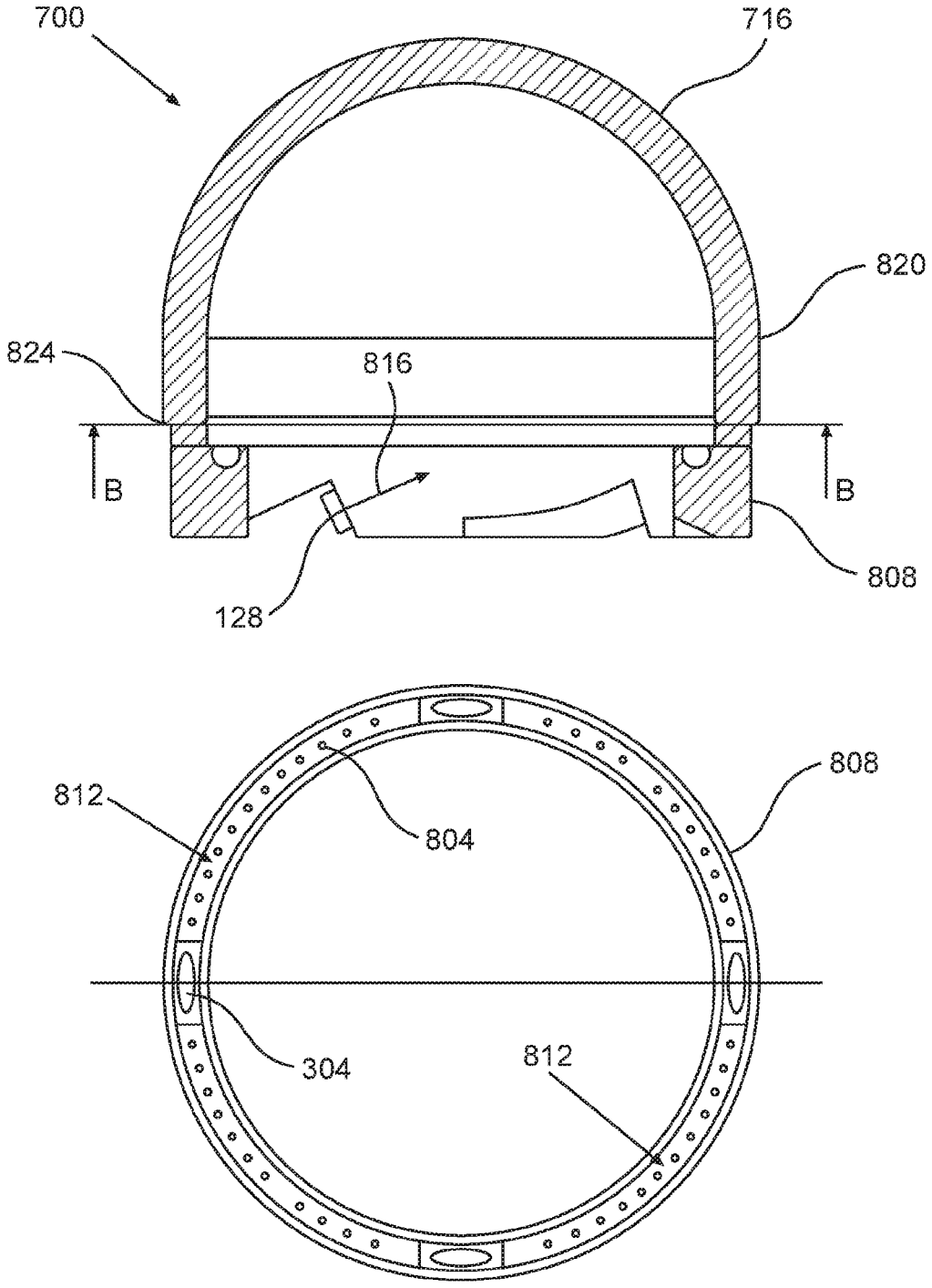
FIG. 8 is an example of an illumination device configured to accept a combination of laser diodes and Light Emitting Diodes as an excitation and illumination source.

In some examples in addition to nests 304 configured to accept laser diodes 128, as shown in FIG. 8, a number of mounts or receptacles 804 receiving Light Emitting Diodes (LEDs) could be made in ring 808. The combination of laser diodes 128 and LEDs could provide a more even and broader spectrum of illumination device or bulb 700.

Laser diodes 128 and light-emitting diodes 804 are mounted on the same ring 808. Laser diodes 128 are inserted into nests 304 made at an angle in ring 808 and light-emitting diodes (for example Chip-On-Board LEDs) are located in their receptacles 804 in sectors 812 of ring 808. Openings or nests 304 between sectors 812 are configured to support the passage of laser beams 816 emitted by laser diodes 128 into cylindrical segment 820 of the globe and further into globe 716.

Light beams emitted by laser diodes 128 and by light-emitting diodes 804 enter into the same annular butt-end 824 of globe 716 and are emitted by the globe as a volumetric light flux.

Figure 9:
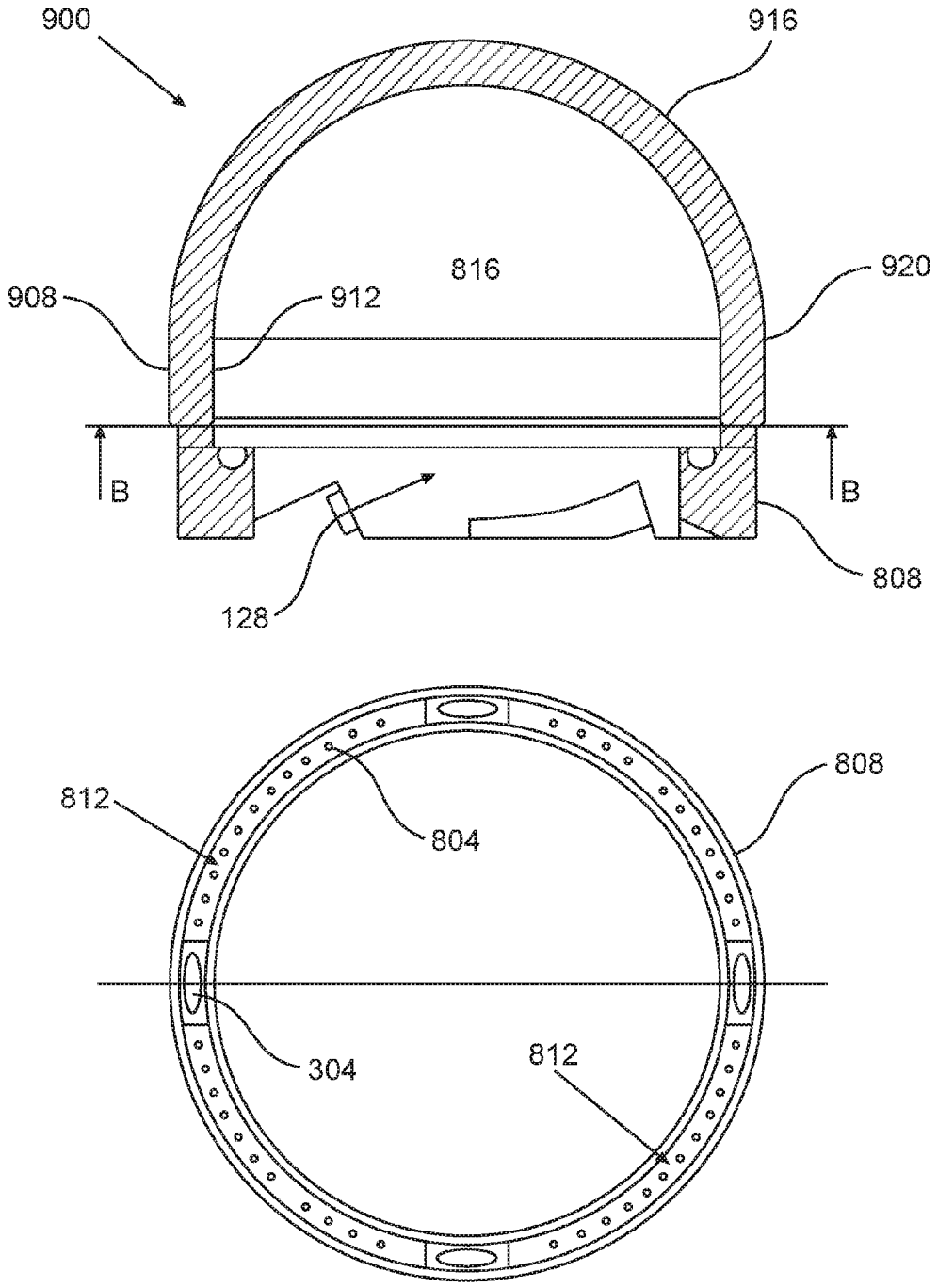
FIG. 9 is an example of an illumination device configured to emit white light.

FIG. 9 is an example of an illumination device configured to emit white light. Illumination device or bulb 900 is generally similar to the construction of bulb 700. The phosphorous coating could be a combination of different phosphors (phosphorous system) that when excited would emit white light. The wavelength of the emission of laser diodes and light-emitting diodes could be selected to support the maximum effectiveness of the excitation and emission of phosphor (for example include the wavelengths, like royal blue (470 nm).

In another example, a number of laser diode sources emitting red, green and blue (RGB) light could be directly coupled into cylindrical segment 920 and/or globe 916. There exist laser diodes with blue wavelength of 457 nm, green wavelength of 532 nm and red wavelength of 635 nm. Additional wavelengths generated by laser diodes or LEDs could be used to provide a better quality and/or larger spectrum white light. As explained above (FIG. 6), laser diode emitted light propagates in cylindrical segment 920 through total internal reflection both outer 908 and inner 912 surfaces of cylindrical segment 920 could be covered by a reflective coating. A mix of all wavelengths enters globe 916 where it is further homogenized.

Emitting surface of globe 916 could be a light diffusing powder-coated surface or a traditional frosted white surface similar to white incandescent bulb coatings. Alternatively the emitting surface of globe 916 could be grinded to disperse incident on it radiation.

Since no phosphors are excited to emit white light, the efficiency of lamp 900 would be higher than the efficiency of phosphor coated lamps. The use of color-mixed laser light supports proper white light spectrum generation and improves color rendering quality. In some examples white light spectrum could be fit to closely resemble sunlight.

In order to provide proper white light spectrum the output powers of the laser diodes could be controlled by any known method.

Figure 10:
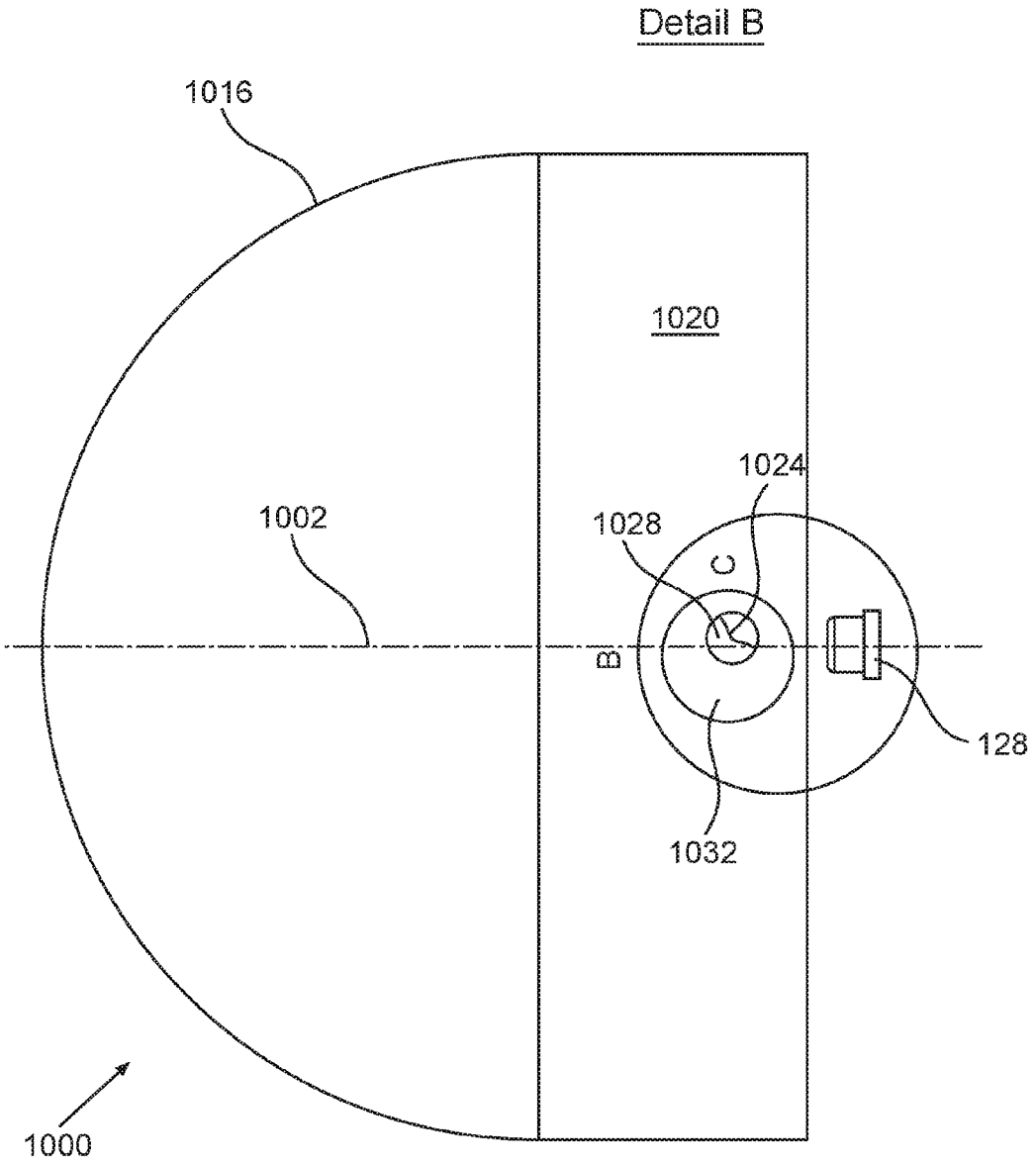
FIG. 10 is another example of laser diodes arrangement and coupling to the globe.
Figure 11:
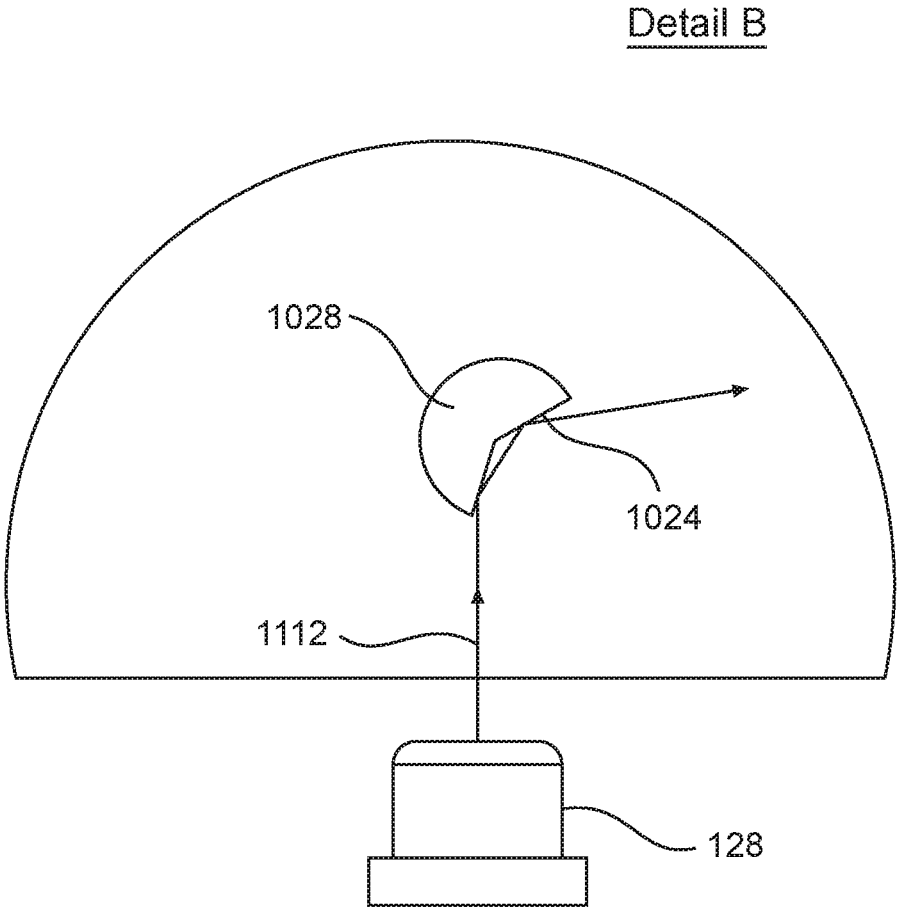
FIG. 11 is a detail of FIG. 10 illustrating the path of a laser beam emitted by a laser diode.

FIG. 10 is another example of laser diodes arrangement and coupling to the globe. Laser diodes 128 are located in a circular arrangement around perimeter of globe 1016 or cylindrical segment 1020. Laser diodes 128 emit light in direction parallel to illumination device or bulb 1000 axis 1002. Laser diodes emitted light is directed to reflecting surfaces 1024 of mirror/mirrors 1028 inserted into receiving nests 1032 of cylindrical segment 1020 of globe 1016 and enter cylindrical segment 1020 of globe 1016. As shown in FIG. 11, which is detail B of FIG. 10 light 1112 emitted by laser diode 128 is reflected from reflecting surfaces 1024 of mirror 1028 and directed into cylindrical segment 1020 of globe 1016 at an angle supporting total internal reflection from the outer and inner surfaces of cylindrical segment 1020 along a spiral trajectory towards covered by a phosphorous coating surface of globe 1016.

Figure 12:
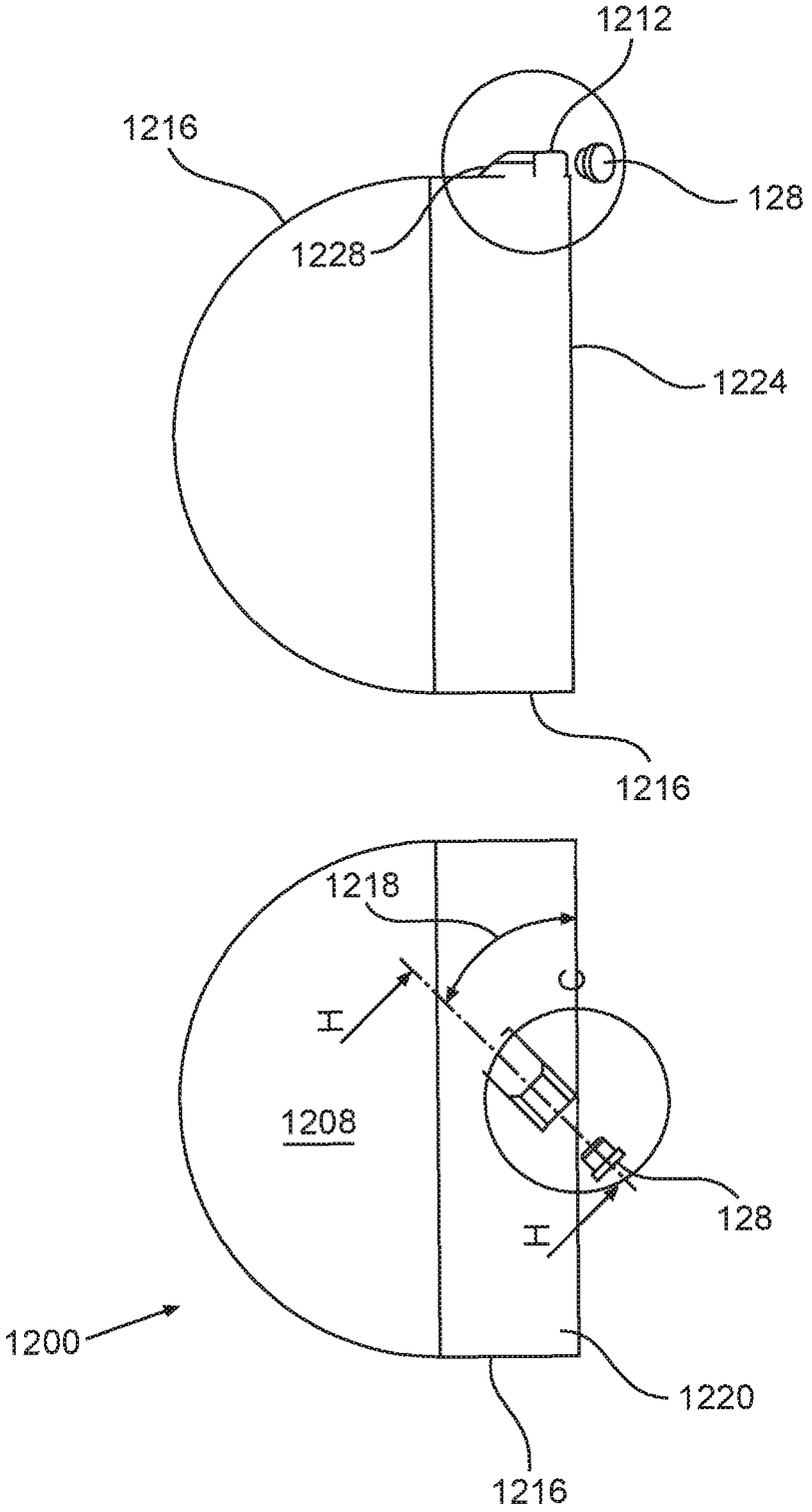
FIG. 12 is an additional example of laser diodes arrangement and coupling to globe.

FIG. 12 is an additional example of laser diodes arrangement and coupling to globe. Globe 1216 of illumination device or bulb 1200 includes a number of protrusions 1212 attached to external surface 1216 of cylindrical segment 1220. Protrusions 1212 are attached to external surface 1216 at an angle 1218 to the surface of 1224 of cylindrical segment 1204 and as shown in detail D terminated by a slanted surface 1228 directing emitted by laser diode 128 beam into cylindrical segment 1220 of globe 1216.

In another example, protrusions 1212 could be attached to inner surface of cylindrical segment 1220. External surface 1216 could now an additional number of laser diodes in an arrangement similar to one shown in FIG. 9.

It will also be appreciated by persons skilled in the art that the present illumination device is not limited to what has been particularly shown and described hereinabove. Rather, the scope of the illumination device includes both combinations and sub-combinations of various features described hereinabove as well as modifications and variations thereof which would occur to a person skilled in the art upon reading the foregoing description.

What is claimed is:

1. An illumination device comprising:

a bulb including a segment of at least second order curvature and a cylindrical segment integral with the segment of at least second order curvature, said cylindrical segment having at least two slanted surfaces, and at least two laser diodes each associated with a corresponding one of the slanted surfaces such that laser beams emitted by the at least two laser diodes propagate inside the bulb through total internal reflection, wherein the laser beams propagate and expand in the bulb, are evenly mixed, alone a helical trajectory, and exceed outward from the bulb as a volumetric light flux.

2. The illumination device according to claim 1 wherein the segment with a shape of at least second order curvature and the cylindrical segment are made of transparent material such as glass or, plastic.

3. The illumination device according to claim 1 wherein the segment with a shape of at least second order curvature and the cylindrical segment are separate segments of the bulb joined integrally together.

4. The illumination device according to claim 1 wherein at least one surface of the cylindrical segment of the bulb is terminated by a flat butt surface.

5. The illumination device according to claim 1 wherein the at least two laser diodes are located in receptacles in a ring of the bulb, some of the receptacles being oriented in the same direction at equal angles and some of the receptacles being oriented in opposite directions at complementary angles.

6. The illumination device according to claim 1 wherein the at least two laser diodes are oriented to emit laser beams directed in the same direction.

7. The illumination device according to claim 1 wherein the at least two laser diodes are oriented to emit laser beams directed in opposite directions.

8. The illumination device according to claim 1 wherein the bulb includes a plurality of receptacles configured to receive Light Emitting Diodes (LEDs).

9. The illumination device according to claim 1 wherein the bulb further comprises a thickness defined by outer and inner surfaces of the bulb.

10. The illumination device according to claim 1 wherein the laser beams propagating in the bulb are repeatedly reflected from the outer and inner surfaces of the bulb.

11. The illumination device according to claim 1 wherein the bulb further comprises a radiating surface and wherein light beams propagating in the bulb illuminate a complete radiant surface of the bulb, and wherein the radiating surface emits volumetric light flux generated by the illumination device.

12. The illumination device according to claim 1 wherein at least the inner surface of the bulb is covered by a reflecting layer to support total internal reflection of laser beams.

13. The illumination device according to claim 1 wherein the laser beams are directed in at least one of a group of directions consisting of a direction tangential to an external surface of the bulb or parallel to illumination device axis.

14. The illumination device according to claim 1 further comprising a laser diode driver located inside the bulb.

15. The illumination device according to claim 1 wherein at least one of outer or inner surfaces of the bulb is covered by a phosphorous coating configured to generate white light when excited by the laser beams emitted by the laser diodes.

16. The illumination device according to claim 1 wherein the laser diodes are selected such that a mix of wavelengths of the laser beams emitted by the laser diodes results in white light emitted by the illumination device.

17. The illumination device according to claim 1 wherein the laser diodes are selected to emit laser beams corresponding to RGB wavelength.

18. The illumination device according to claim 1 further comprising at least one protrusion attached to an external surface of the cylindrical segment terminated by one of the slanted surfaces directing one of the laser beams into the cylindrical segment.

19. The illumination device according to claim 1 wherein the cylindrical segment of the bulb is configured to receive the laser beams emitted by the laser diodes and light beams from LEDs and couple the beams into the bulb.

* * * * *